US007690893B2

(12) United States Patent
Cunha

(10) Patent No.: US 7,690,893 B2
(45) Date of Patent: Apr. 6, 2010

(54) LEADING EDGE COOLING WITH MICROCIRCUIT ANTI-CORIOLIS DEVICE

(75) Inventor: Francisco J. Cunha, Avon, CT (US)

(73) Assignee: United Technologies Corporation, Hartford, CT (US)

( * ) Notice: Subject to any disclaimer, the term of this patent is extended or adjusted under 35 U.S.C. 154(b) by 667 days.

(21) Appl. No.: 11/493,938

(22) Filed: Jul. 25, 2006

(65) Prior Publication Data

US 2010/0008758 A1 Jan. 14, 2010

(51) Int. Cl.
*F01D 5/18* (2006.01)

(52) U.S. Cl. ..... 416/97 R

(58) Field of Classification Search ..... 416/97 R, 416/96 R

See application file for complete search history.

(56) References Cited

U.S. PATENT DOCUMENTS 6,379,118 B2 * 4/2002 Lutum et al. ..... 416/97 R
6,955,522 B2 * 10/2005 Cunha et al. ..... 415/115
6,955,525 B2 * 10/2005 Liang ..... 416/97 R
7,011,502 B2 * 3/2006 Lee et al. ..... 416/97 R
2004/0219016 A1 * 11/2004 Demers et al. ..... 416/97 R

FOREIGN PATENT DOCUMENTS

EP 1467064 A2 10/2004
GB 2399405 A 9/2004

OTHER PUBLICATIONS

European Search Report dated Oct. 8, 2009.

* cited by examiner

*Primary Examiner*—Edward Look
*Assistant Examiner*—Dwayne J White
(74) *Attorney, Agent, or Firm*—Bachman & LaPointe, P.C.

(57) ABSTRACT

A turbine engine component, such as a high pressure turbine blade, has an airfoil portion having a pressure side, a suction side, and a leading edge. A cooling system is provided within the leading edge. The cooling system includes at least one peripheral leading edge cooling channel for creating anti-Coriolis forces in the leading edge of the airfoil portion.

12 Claims, 5 Drawing Sheets

LEADING EDGE COOLING WITH MICROCIRCUIT ANTI-CORIOLIS DEVICE

BACKGROUND (1) Field of the Invention

The present invention relates to a turbine engine component having a leading edge cooling system which is desensitized to the effects of Coriolis forces.

(2) Prior Art

In cooling high thermal load leading edges for turbine high pressure blades, coolant flow is usually supplied by a feed cavity to the blade leading edge. Usually, coolant flow passes through a series of cross-over holes for impingement onto the internal surface of the blade. The impingement heat transfer along with film protection at the leading edge are the traditional heat transfer mechanisms for cooling the blade leading edge. As the blade rotates, the rotational heat transfer in certain areas of the feed cavity may increase at the trailing side of the cavity and decrease on the leading side of the cavity. As the blade rotates, a pressure gradient is set inside the passage to balance the in-plane Coriolis forces. The flow tends to move from the leading side towards the trailing side. On the leading side, the radial velocity profile is gradual in comparison with the profile at the trailing side. In this case, the radial velocity profile is attached to the airfoil walls at the trailing side leading high shear stresses and correspondingly high heat transfer coefficients. The opposite is verified for the leading side of the cooling flow passage. Therefore, the coolant flow in the feed passage experiences forces that create crosswise circulation cells. These cells are large vortices in the main bulk region and smaller Goertier type vertices close to the trailing side. The direct implication of these flow disturbances is the uneven heat pick-up inside the feed cavity.

In general, the external heat flux profile attains the highest values at the blade leading edge. To overcome this thermal load situation, with potential uneven heat pick-up due to Coriolis forces, it is necessary to desensitize the cooling system.

SUMMARY OF THE INVENTION

In accordance with the present invention, there is provided a turbine engine component, such as a high pressure turbine blade, with a leading edge cooling system which is desensitized to the effects of Coriolis forces.

In accordance with the present invention, there is provided a turbine engine component. The turbine engine component broadly comprises an airfoil portion having a pressure side, a suction side, and a leading edge, a cooling system within the leading edge, and the cooling system includes means for creating anti-Coriolis forces in the leading edge of the airfoil portion.

Further, in accordance with the present invention, there is provided a process for improving cooling effectiveness in a leading edge of an airfoil portion of a turbine engine component. The process broadly comprises providing a cooling system having a leading edge cavity in the airfoil portion, flowing a cooling fluid through the leading edge cavity, and desensitizing the cooling system to Coriolis force effects.

Other details of the leading edge cooling with microcircuit anti-Coriolis device of the present invention, as well as other objects and advantages attendant thereto, are set forth in the following detailed description and the accompanying drawing(s) wherein like reference numerals depict like elements.

DETAILED DESCRIPTION OF THE PREFERRED EMBODIMENT(S)

Figure 1:
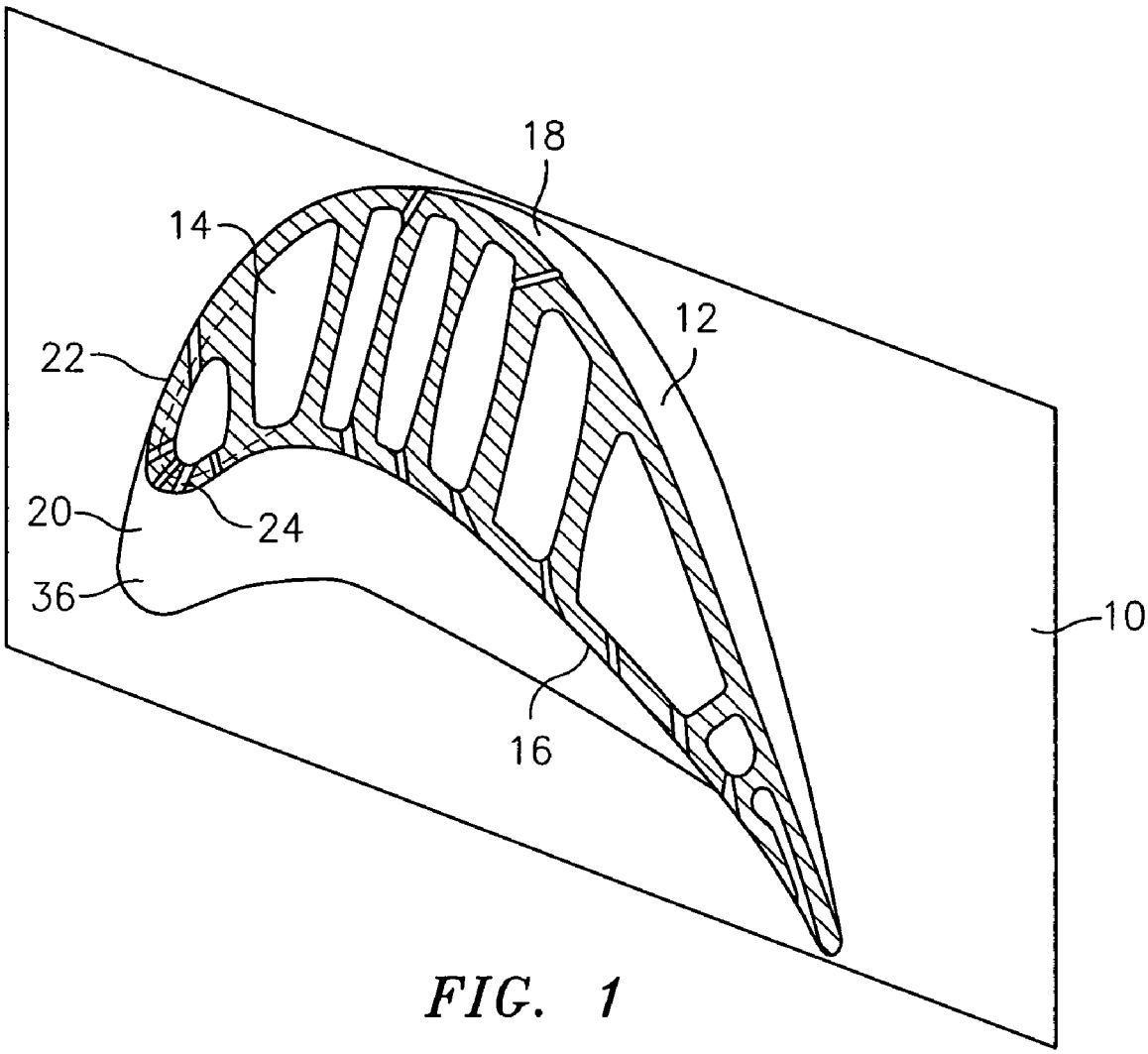
FIG. 1 is a schematic representation of an airfoil portion of a turbine engine component having a leading edge cavity for cooling the leading edge of the airfoil portion.

Referring now to the drawings, FIG. 1 illustrates an airfoil portion 12 of a turbine engine component 10, such as a high pressure turbine blade, having a leading edge cooling system 14. The airfoil portion 12 has a pressure side 16, a suction side 18, and a leading edge 20. The cooling system 14 includes a leading edge cavity 22 through which a cooling fluid, such as engine bleed air, flow in a radial direction. In accordance with the present invention, to desensitize the cooling system 14, the internal flow forces are steered in a way shown in FIG. 2.

Figure 2:
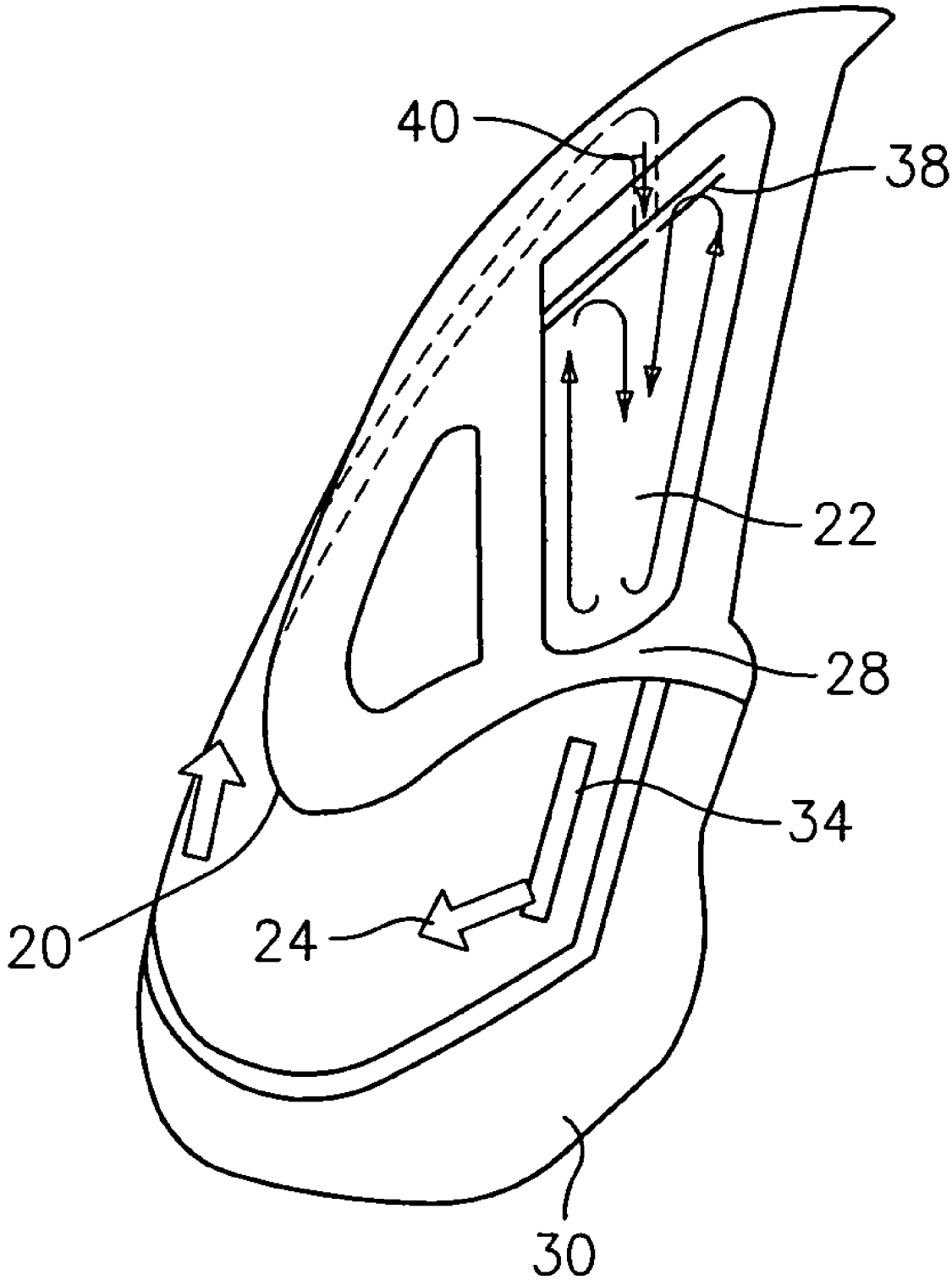
FIG. 2 is an enlarged view of the leading edge cooling system with anti-Coriolis channels.

FIG. 2 illustrates a way to effectively capture the Coriolis force effects that are created as the turbine engine component 10 rotates. As indicated above, these forces are undesirable because they lead to uneven heat pick-up by the coolant flowing through the cooling system 14. It is known that these forces will exist since the angular velocity of the turbine engine component 10 and the relative coolant flow velocity occur simultaneously in the blade. In accordance with the present invention, a portion of coolant flow through cavity 22 is driven to enter one or more leading edge channels 24 by the Coriolis forces. Each peripheral leading edge channel 24 wraps around the leading edge 20 of the airfoil portion 12. Each leading edge channel 24 may be formed in the leading edge 20 of the airfoil portion 12 during the casting process using refractory metal cores which are attached to the main body silica cores in a usual investment casting process.

Figure 3:
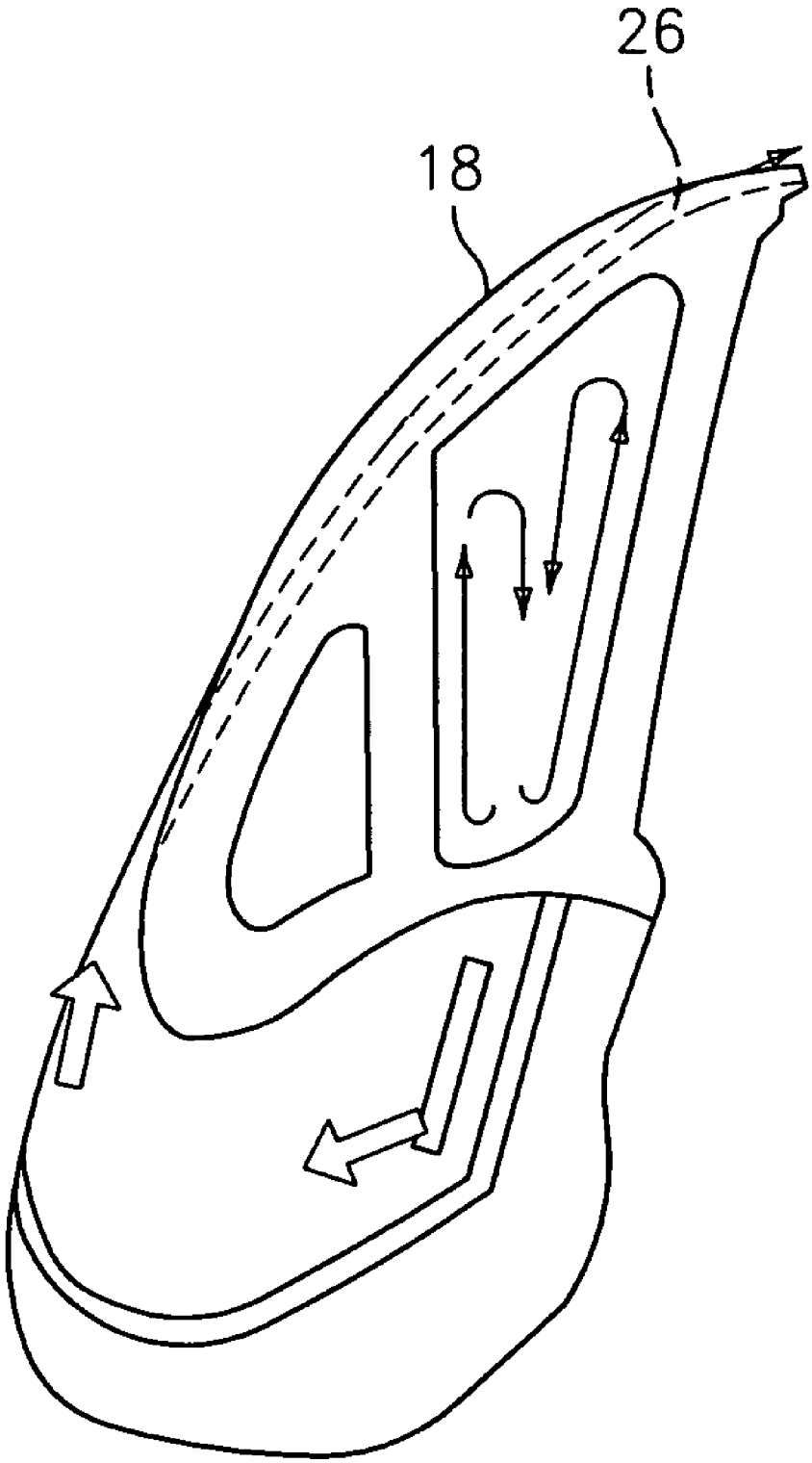
FIG. 3 is an alternative embodiment of a leading edge cooling system in accordance with the present invention having a film cooling slot in a suction side of the airfoil portion.

As the coolant flow passes through the peripheral leading edge channel(s) 24, it forms an anti-Coriolis effect inside the cavity 22. This is particularly true if the flow passing through the leading edge channel(s) 24 is not allowed to return to the feed cavity 22 by having one or more film cooling slots 26 (see FIG. 3) on the suction side 18 of the airfoil portion 12. When this is the case, the radial coolant flow velocity profile close to the walls 28 of the feed cavity 22 is even leading to uniform wall shear stresses and consequently even heat pick-up in the feed cavity 22.

Figure 4:
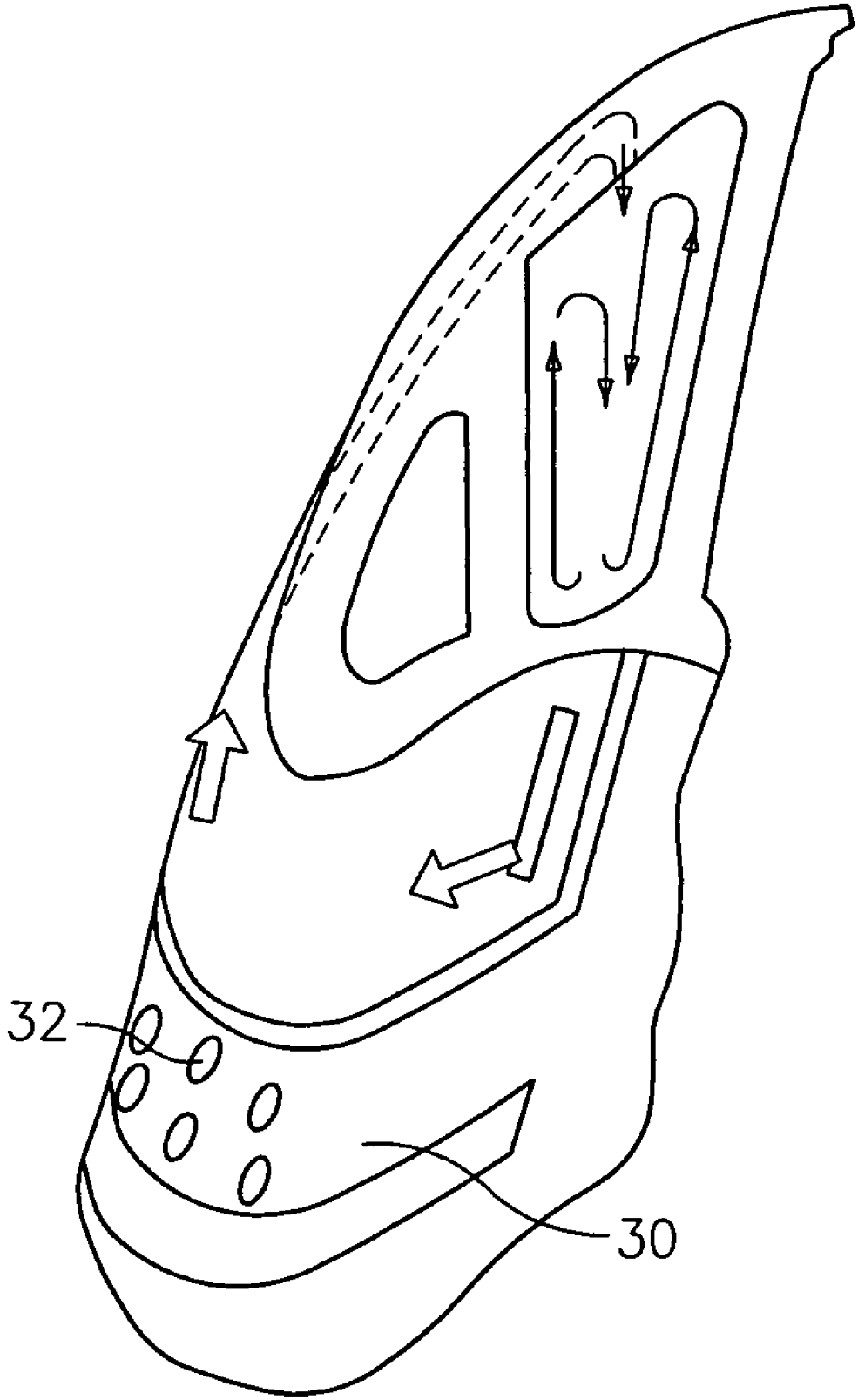
FIG. 4 illustrates a transverse rib having leading edge holes used to separate adjacent peripheral leading edge channels.

If desired, the leading edge peripheral channels 24 in FIG. 2 can be separated by one or more transverse ribs 30. The height of these ribs 30 could be such that it would allow for leading edge holes 32 to be machined through the ribs 30, as shown in FIG. 4; thus complementing the turbine engine component leading edge cooling.

Each of the leading edge peripheral channels may have one or more admission ports 34 for allowing cooling fluid to flow from the cavity 22 into the channel(s) 24. The admission port(s) 34 may each be sized to obtain pressure levels to prevent excessive mechanical stresses in the leading edge skin cover 36.

Figure 5:
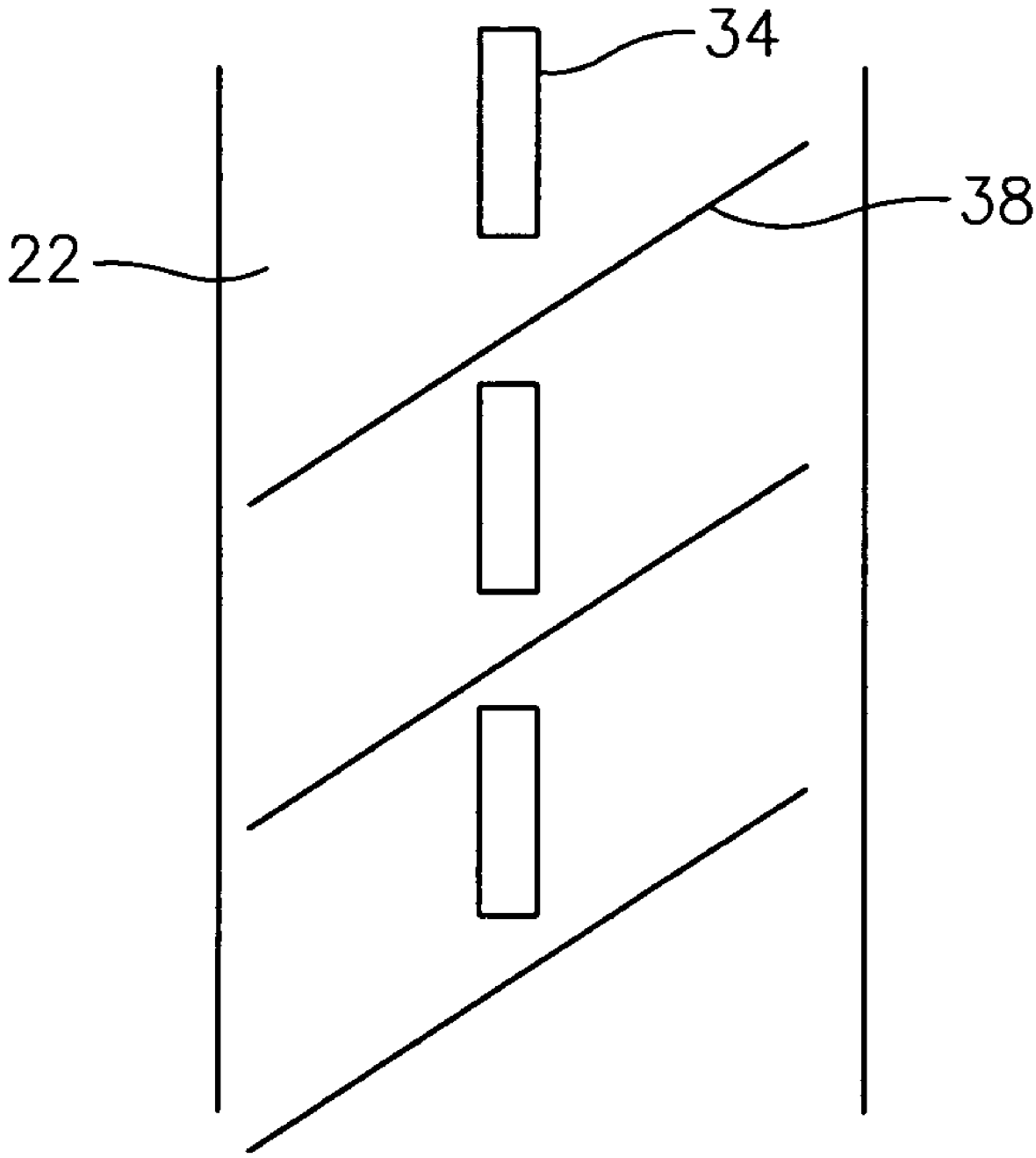
FIG. 5 illustrates a feed cavity having a plurality of trip strips.

Referring now to FIG. 5, if desired, one or more trip strips 38 could be used inside the feed cavity 22 to turbulate the flow further; thus enhancing coolant heat pick-up. The trip strips 38 may be mounted to the walls of the feed cavity 22 using any suitable means known in the art.

If desired, as shown in FIG. 2, each of the leading edge channels 24 may have one or more discharge ports 40 for returning cooling fluid to the feed cavity 22. The discharge port(s) 40 can be used if aerodynamic losses due to mixing are to be eliminated from external film cooling of the airfoil portion 12. In this situation, a force balance could be designed to benefit the design as opposed to have uncontrolled flow fields subjected to uncontrolled rotational forces.

The refractory metal core manufacturing process lends itself to this design for cooling the leading edge of an airfoil portion of a turbine engine component. However, other manufacturing techniques could also be used. For instance, a metal sheet can be formed and trimmed for the airfoil contour before bonding in a bond tool with hot vacuum press operation. The quality of the bond can be checked with techniques such as holographic interferometry, radiography, and others. In the end, an overlay coating may be used followed by a thermal barrier coating.

The new anti-Coriolis device of the present invention provides a number of benefits including: (1) reduction of through wall thermal gradients; (2) use of anti-Coriolis forces for leading edge microcircuit peripheral channels; (3) desensitizing the leading edge from high thermal heat fluxes; (4) minimizing the effects of Coriolis forces in the feed cavity; (5) providing even heat transfer; and (6) providing a system which can be used in a closed-loop system to minimize aerodynamic losses with external film. Further, film cooling holes can be provided by machining holes through the supporting ribs or through the exit slots formed from the peripheral cooling channels wrapped around the turbine engine component leading edge to complement overall blade leading edge cooling. Yet another benefit of the present invention is that cooling flow is minimized by taking advantage of rotational forces for turbine engine component leading edge cooling. Also, aerodynamic losses are minimized from the film cooling mixing at the turbine engine component leading edge. Still further, even heat transfer distribution can be maintained at the feed cavities to the turbine engine component leading edge.

It is apparent that there has been provided in accordance with the present invention a leading edge cooling with microcircuit anti-coriolis device which fully satisfies the objects, means, and advantages set forth hereinbefore. While the present invention has been described in the context of specific embodiments thereof, other unforeseeable alternatives, modifications, and variations may become apparent to those skilled in the art having read the foregoing description. Accordingly, it is intended to embrace those alternatives, modifications, and variations as fall within the broad scope of the appended claims.

What is claimed is:

1. A turbine engine component comprising:

an airfoil portion having a pressure side, a suction side, and a leading edge;

a cooling system within said leading edge; and said cooling system including means for creating anti-Coriolis forces in the leading edge of the airfoil portion, wherein said cooling system further includes a feed cavity in said leading edge through which a cooling fluid flows in a radial direction, wherein said anti-Coriolis forces creating means comprising at least one peripheral channel in said leading edge, and wherein each said peripheral channel has at least one discharge port for discharging cooling fluid back into said feed cavity.

2. The turbine engine component according to claim 1, wherein each said peripheral channel has at least one admission port for allowing cooling fluid from said feed cavity to enter said respective peripheral channel.

3. The turbine engine component according to claim 1, further comprising each admission port being sized to obtain pressure levels to prevent excessive mechanical stresses in a leading edge skin cover.

4. The turbine engine component according to claim 1, further comprising a plurality of peripheral channels in said leading edge.

5. The turbine engine component according to claim 4, further comprising at least one transverse rib between adjacent ones of said peripheral channels.

6. The turbine engine component according to claim 5, wherein said at least one transverse rib has at least one hole for allowing cooling fluid from one of said peripheral channels to flow to another of said peripheral channels.

7. The turbine engine component according to claim 1, further comprising at least one trip strip placed within said feed cavity.

8. The turbine engine component according to claim 1, wherein said at least one peripheral channel wraps around said leading edge of said airfoil portion.

9. The turbine engine component according to claim 1, wherein said turbine engine component comprises a high pressure turbine blade.

10. A turbine engine component comprising:

an airfoil portion having a pressure side, a suction side, and a leading edge;

a cooling system within said leading edge;

said cooling system including a leading edge cavity through which a cooling fluid flows in a radial direction and means for creating an anti-Coriolis effect inside the leading edge cavity;

said anti-Coriolis effect creating means comprising at least one peripheral channel in said leading edge;

each said peripheral channel being formed in the leading edge and wrapping around said leading edge of said airfoil portion, and at least one film cooling slot on only the suction side of the airfoil portion so that a radial coolant flow velocity profile close to walls of the leading edge cavity is leading to uniform wall shear stresses and even heat pick-up in the leading edge cavity.

11. The turbine engine component according to claim 10, further comprising each said peripheral channel having at least one admission port for allowing cooling fluid to flow from the leading edge cavity into a respective peripheral channel and each said admission port being sized to obtain pressure levels to prevent excessive mechanical stresses in a leading edge skin cover.

12. A turbine engine component comprising:

an airfoil portion having a pressure side, a suction side, and a leading edge;

a cooling system within said leading edge;

said cooling system including a leading edge cavity through which a cooling fluid flows in a radial direction and means for creating an anti-Coriolis effect inside the leading edge cavity;

said anti-Coriolis effect creating means comprising at least one peripheral channel in said leading edge; and each said peripheral channel being formed in the leading edge and wrapping around said leading edge of said airfoil portion, wherein each peripheral channel has at least one discharge port for returning cooling fluid to the leading edge cavity.

* * * * *